United States Patent [19]

McSweeney et al.

[11] Patent Number: 4,773,490

[45] **Date of Patent: * Sep. 27, 1988**

[54] ROOF DRILLING SYSTEM

[76] Inventors: Lawrence H. McSweeney; Larry J. McSweeney, both of Rt. 1, Box 800, South Point, Ohio 45680

[ * ] Notice: The portion of the term of this patent subsequent to Oct. 22, 2004 has been disclaimed.

[21] Appl. No.: 78,971

[22] Filed: Jul. 29, 1987

Related U.S. Application Data

[63] Continuation-in-part of Ser. No. 800,689, Nov. 22, 1985, Pat. No. 4,702,328.

[51] Int. Cl.[4] ..... E21B 17/00; B23B 31/04

[52] U.S. Cl. ..... 175/320; 279/19.3

[58] Field of Search ..... 175/320, 321; 279/19, 279/19.3, 89; 285/401, 404; 173/38, 163, 164

[56] References Cited

U.S. PATENT DOCUMENTS

| | | | |
|---|---|---|---|
| 3,498,624 | 3/1970 | Hammond et al. | 279/89 X |
| 3,599,996 | 8/1971 | Holt | 279/89 X |
| 4,226,290 | 10/1980 | McSweeney | 175/320 |
| 4,627,626 | 12/1986 | Röhm | 279/19.3 X |
| 4,702,328 | 10/1987 | McSweeney et al. | 175/320 |

*Primary Examiner*—George A. Suchfield

*Assistant Examiner*—David J. Bagnell

*Attorney, Agent, or Firm*—Sidney W. Millard

[57] ABSTRACT

A roof-drilling system for use in subterranean mining applications and the like in which the drill head of a roof drilling machine is arranged such that the receiving cavity of its chuck is configured having a lost motion association with the drive-in portion of starter and driver drill steel rods. The lower surface of a retainer fixed to the drill head and having a non-circular aperture formed therein serves to define one bearing surface for utilizing the drill head itself to pull the assemblage of drill steel from a completed bore. To remove the drill steel driver component from the drill head chuck, the miner grasps the lowermost portion and rotates it a relatively small amount. To provide for interlocking of various components of the drill steel, i.e. driver component, extension components finishing rods and the like, the tips of the male ends of each component are formed having a shallow external groove and each corresponding female socket is provided with a corresponding transversely oriented mirror image bore. Conventional wire or its equivalent is inserted within the bore by the miner in the course of assembly the drill steel during a drilling operation.

20 Claims, 5 Drawing Sheets

FIG. 13
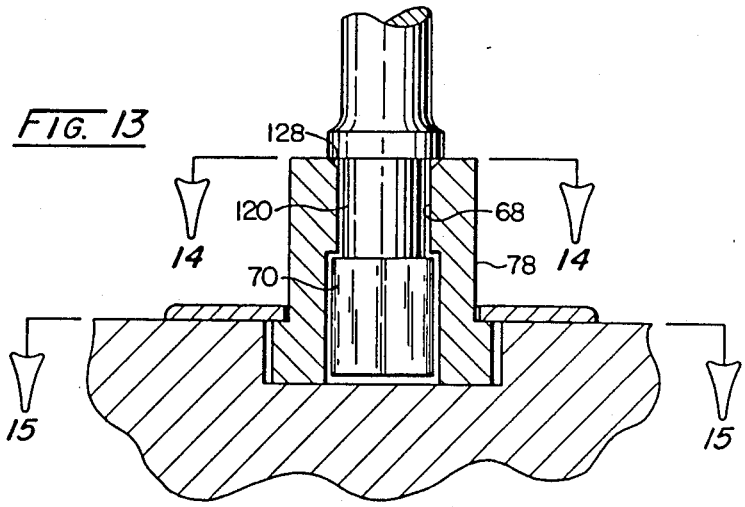
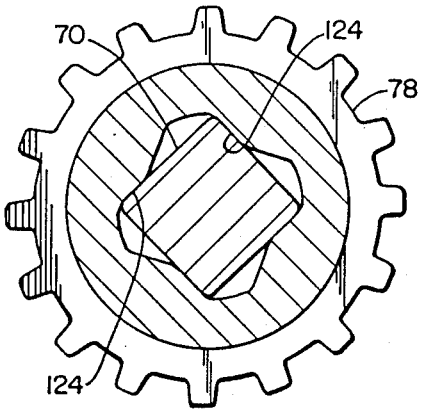
FIG. 14
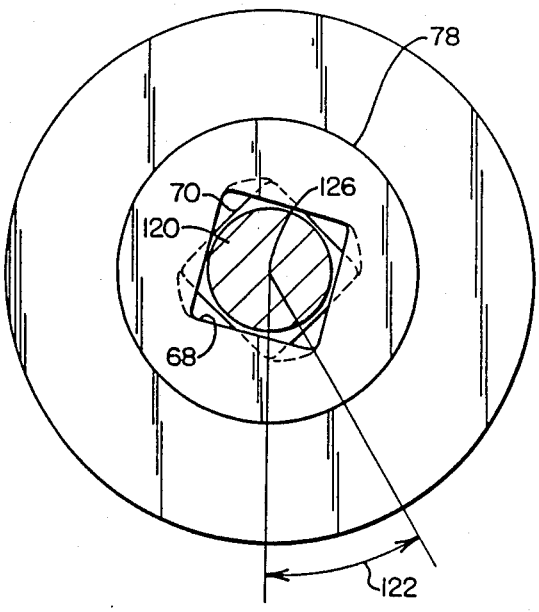
FIG. 15

ROOF DRILLING SYSTEM

This application is a continuation-in-part of application Ser. No. 800,689 filed Nov. 22, 1985, now U.S. Pat. No. 4,702,328.

FIELD OF THE INVENTION

This invention is concerned with the apparatus for drilling roof holes in mines and for withdrawing the drill rods when desirable.

BACKGROUND OF THE INVENTION

Procedures utilized for the subterranean mining of coal have been greatly improved over the past several decades, both from the standpoint of operational safety on the part of miners as well as from the standpoint of their productivity. However, mining practices still are considered to be labor intensive, a factor significant in the pricing of coal. Additionally, current mining procedures necessarily continue to pose severe occupational safety difficulties. While current techniques of subterranean mining specific to a given strata being worked may represent a variety of technical approaches, the sequence of a given coal mining operation tends to follow a general pattern wherein machines of one variety or another work at the face of a seam to extract coal which then is conveyed outwardly from the mine. During this extraction procedures, there is created a progressively expending subterranean cavern or chamber. As this procedure is carried out, the structural integrity of the immediately adjacent portions of the cavern roof or supporting portions is jeopardized. Consequently, the roof must be buttressed.

A variety of techniques have been developed and continue to be developed to achieve roof integrity, however, an important and most prevalent one of such techniques provides for the utilization of what are referred to in the art as "roof bolts". Engineering analysis of the function of roof bolts have been set forth in a variety of publications, an example of such being: "Elements of Mining", 3rd ed. by Lewis et al, John Wiley & Sons, Inc., New York. Typically, the procedure for bolting involves first, the carrying out of vertical and predetermined angular drilling through the roof of a recently mined area. This drilling normally will extend at least through a predetermined height of strata. Next, elongate steel bolts are inserted into the bores and anchored therewithin. A face plate is mounted over the lower end of the bolt and abutting the roof surface. Tension is applied to the anchored bolt by a nut threaded on the lower end of the bolt and forcing the face plate upward, thereby placing the rock within which the bolt extends under compression parallel to the bolt. The pattern of bores in the roof must be selected such that a proper support for the rock structure is derived. Typically, the bores will be arranged on about a maximum of a four feet (1.2 m.) mutual centering. The bolts serve a variety of purposes, for instance they may be employed to secure fragments or sections of rock material which are loose and subject to dropping out of place. Their most imperative utilization has been described as "beam building" wherein the bolts are installed in bedded rock to bind the overlying strata together to act as a single beam capable of supporting itself and thus stabilizing the overlying rock. The bolt should be long enough to form a "monolythic" beam which will be self-supporting and not merely be suspended from the stratum in which the bolts are anchored.

A typical roof bolt is comprised of a length of somewhat flexible steel, the upwardly disposed end of which is operationaly coupled to a point anchor present as an expansion shell or slot and wedge type anchor. The steel bolts are inserted within a roof bore and the exposed ends manipulated in connection with a roof engaging plate to expand the anchor and, subsequently, tension the bolt along its length. Over the relatively recent past, resin-anchored roof bolts have found use in roofs composed of strata more difficult to secure i.e. "wet roofs" and the like. These bolts incorporate a thixotropic resin formulation which is activated following insertion within a roof bore to create a tight bond between the bore surface and rod. See "Use of Resin-Anchored Roof Bolts in Adverse Conditions", Mining Congress Journal, Vol. 60, pp. 37–40, January, 1974. Flexibility of all forms of roof bolts is required, inasmuch as mining cavern roof (seam) heights have become quite low, substantially all mining equipment now being fabricated for operation at roof heights as low as about thirty inches.

Installation of the roof bolts in accordance with the prevailing or most current practice is quite hazardous. Mining personnel are required to operate under a low unsupported roof portion of the mine and to induce shock producing phenomena in the course of drilling appropriate bores extending through the strata, as well as in the subsequent removal of drill steel and manipulation or stressing of the roof bolts to achieve a necessary beam forming effect. These safety problems as well as associated economic problems have been reported to represent the cause of an estimated 1,114 compensable accidents per year and 1,621 non-compensable accidents per year. The estimated man-days lost per year for this mining function on a non-fatal compensable basis is 60,000 while the noncompensable estimated man-days lost per year has been reported at 2600. In 1973 the five-year total of fatal accidents was set at 50 for roof bolters. See in this regard, "Coming Soon—New Mining Concepts and Equipment for Improved Safety and Production Capabilities", Coal Age, Vol. 78, pp. 137–143, July 1973.

The types of accidents involved in roof bolting vary in scope, certain of them doubtlessly stemming from the more prevalent roof drilling practices. These practices involve the utilization of a hydraulically actuated drilling machine having an arm portion which progressively urges rotating drill steel into the bore at a selected location. Due to the low seam heights now virtually universally encountered, many if not most roofs require bores of a length greater than the height of the cavern in which the operator performs the roof bolting function, the drill steel or drill rods usually being provided as a series of interconnectable components. These components are coupled in chain-like fashion to provide a progressively enlarging length of drill as the bore is formed. See, for example, U.S. Pat. Nos. 3,554,306; 3,187,825; 4,009,760; and 4,226,290. Upon providing a bore of extensive length, it is necessary that the drill rod or steel be removed from the bore. One typical practice for carrying out this removal provides for the attachment of a fork or the like to the lowermost stem portion of the drill and forceably withdrawing the drill steel from the bore. More commonly, the drill steel is removed by hand, the miner grasping the last protruding portion of the drill rod and yanking, hammering and otherwise physically removing it while disconnecting its component sections. Because the bores are not always regular and in view of the extremely rigorous drilling conditions involved in mining, many of the drill rods are partially destroyed as well as bent and become very difficult to remove from the bore by hand. Further complicating the matter, in most instances, the drill steel is extremely hot due to the frictional engagement with the strata through which it has been utilized. A common practice is to connect a chain between the protruding drill component and drill head, following which the head is hydraulically driven downwardly to forcibly remove the drill steel. The occupational hazards involved in drill steel removal, accordingly, become apparent. Further, inasmuch as many sections of drill steel must be abandoned in the bores by virtue of an inability of the miners to remove them, requisite patterns for achieving beam strength within roofs may not be realized, much to the detriment of mining safety, and the lost drill steel must be replaced to add to production expense. Great improvement has been achieved recently due to the technology embodied in the aforementioned U.S. Pat. No. 4,226,290 and this invention is an improvement on that technology.

In many instances, certain of the interconnected components of the drill steel are lost by virtue of their frictional engagement within the bore which they have formed. For the most part, the drill steel components are interconnected by slideably mating male and female connections which have no provision for providing tensional coupling to permit forced withdrawal from a bore. Attempts to alleviate this lost steel have generally looked to the use of pins which are driven through mating bores which are formed within the female and male connections. However, such arrangements are found to be impractical in actual mining practice. The miner, generally operating in a posture somewhat near to prone, will remain entirely unappreciative of requirements for carrying punch and hammer first to insert, then to remove the pins as the drill steel is withdrawn from the bore. Such removal within a mine atmosphere is both hazardous and entirely impractical from a human engineering standpoint. The technique in U.S. Pat. No. 4,226,290 uses wire which is much easier to insert and remove.

Attempts to alleviate the hazards and difficulties of roof drilling generally have looked to the promise of complete automation of the roof support process. With regard to future promise for such automation, reference is made to the following publications:

> "Technological Innovations Abound in Coal Mountains of Appalachia" Coal Age, Vol. 80, pp. 242–250, mid-May 1975.

> "Automated Continuous Roof Support", Coal Age Vol. 80, pp. 115–117, July, 1975.

As is apparent from the above discourse, as a prelude to the highly indefinite development of an automated roof supportive system, the industry will recognize considerable advantage in improved efficiencies in roof bolting techniques. In this regard, techniques wherein the time period spent by the miner under unsupported roof during bolting is lessened and the drilling procedure simplified will improve both the safety aspects and efficiency of that required undertaking.

SUMMARY OF THE INVENTION

The present invention is addressed to a roof drilling system for subterranean mining applications improving the efficiency, safety and economics of present-day mine securing techniques. Recognizing the realities of the physical requirements levied upon miners carrying out roof drilling operations, the system of the invention provides for a convenient withdrawal of drill steel immediately following formation of a roof bore without disconnection of the drill steel from the drill head of the drilling apparatus. However, once the drill head is lowered from the face of the bore and, consequently, the drill steel assemblage is lowered, a simple, hand-twisting maneuver on the part of the miner provides for full disconnection of the drill steel from the drill head chuck. The miner may move rearwardly from the formed roof bore during the lowering of the drill head for safety purposes and is not called upon to hammer upon, yank and otherwise exert himself while performing under the difficult thin seam mining operations typically encountered.

The invention further contemplates an arrangement wherein a chain or assemblage of drill steel components may be easily interconnected to permit assured withdrawal from a bore. With the invention, as the drill steel components, i.e. middle extension and finisher, are assembled in the course of forming a bore, the miner is called upon to insert through a surface bore thereof a simple piece of wire or metal which functions to provide adequate tensile integrity to the chain of drill components while remaining highly simple to remove for disassembly following drilling. discards it upon the mine floor. No punches and hammers are required and it is the general observation that wire and pliers are plentiful in a typical subterranean mine environment, whereas the pins and punches, heretofore deemed ineffective, are not readily available and are easily lost in the environment of the unsupported roof.

Another aspect and object of the invention is to provide an improved roof drilling system for subterranean mining applications wherein the drill head of a roof drilling machine is driveably elevated from and lowered to mine floor level along a given drill axis. The drill steel assembly component, which is received within the receiving cavity of the chuck of a drill head, for example, a driver bar or starter bar or combination of the both, is formed having a drive-in portion at one end which is configured such that the driven lowermost portion thereof intended for insertion within the receiving cavity of the drill head chuck extends a predetermined length to a neck having a maximum cross-sectional dimension less than the driven lowermost portion maximum corresponding dimension. The drill head receiving cavity is configured having a right cross-sectional profile for providing a predetermined extent of rotational lost motion freedom about the drill axis with respect to the noted drive-in portion lowermost portion inserted therein. A retainer arrangement, such as a plate fixed and mounted upon the drill head and having a non-circular aperture formed therein of profile configured to slideably receive the driven lowermost portion of the drive-in portion, is provided. The lowermost surface of this retainer provides a bearing surface abuttable against the bearing surface defined by the noted neck and driven lowermost portion at such time as the drill head is lowered from the face of the bore. With such an arrangement, drill steel may be driveably removed from the roof bore which it has formed. As the drill head is lowered, the miner grasps the drill steel component and rotates it the less than one-half turn to permit fascile removal from the drill head. In a preferred arrangement, the drill head receiving cavity is configured having a perimeter defining three, four or six lobes within each of which a respective corner of the drill steel assembly component driven lowermost portion, when inserted within the cavity, is rotatable to the extent of the noted rotational lost motion freedom. For this arrangement, that lowermost driven portion preferably is of some specified cross-sectional impact area.

Another aspect and object of the invention is to provide a roof drill steel assembly for mining operations wherein the male end of each of the drill steel components forming the assembly has a groove adjacent the tip thereof. Additionally, each of the female sockets within which the male end slideably, nestably is received is formed having a transverse hole or aperture through the wall thereof which is positioned as to directly communicate with the male end groove. When the male end is inserted within the female socket, the hole and groove are so substantially aligned as to permit the manual positioning therein of a locking wire which serves to retain the drill steel components against mutual separation at their sockets. The wire arrangement is one permitting the use of materials readily available within the subterranean environment of the mine and is so simple as to be of practical use in the difficult working conditions encountered, particularly in low seam coal. Preferably, the groove is very shallow, having an internal minimum transverse cross-sectional dimension substantially equivalent to corresponding minimum transverse cross-sectional dimension of the male end. For structural reasons, the groove preferably is positioned about three-eights inch from the tip of the male end of the drill steel component.

Other objects of the invention will, in part, be obvious and will, in part, appear hereinafter.

The invention, accordingly, comprises the system and apparatus possessing the construction, combination of elements and arrangement of parts which are exemplified by the following detailed disclosure.

For a fuller understanding of the nature of the invention, reference should be had to the following detailed description taken in connection with the accompanying drawings.

BRIEF DESCRIPTION OF THE DRAWINGS

FIG. 13 is a sectional view similar to FIG. 6 of a third embodiment of the chuck and receiving cavity;

FIG. 14 is a sectional view taken along line 14—14 of FIG. 13; and

FIG. 15 is a partial sectional view taken along line 15—15 of FIG. 13.

DESCRIPTION OF THE PREFERRED EMBODIMENTS

Figure 1:
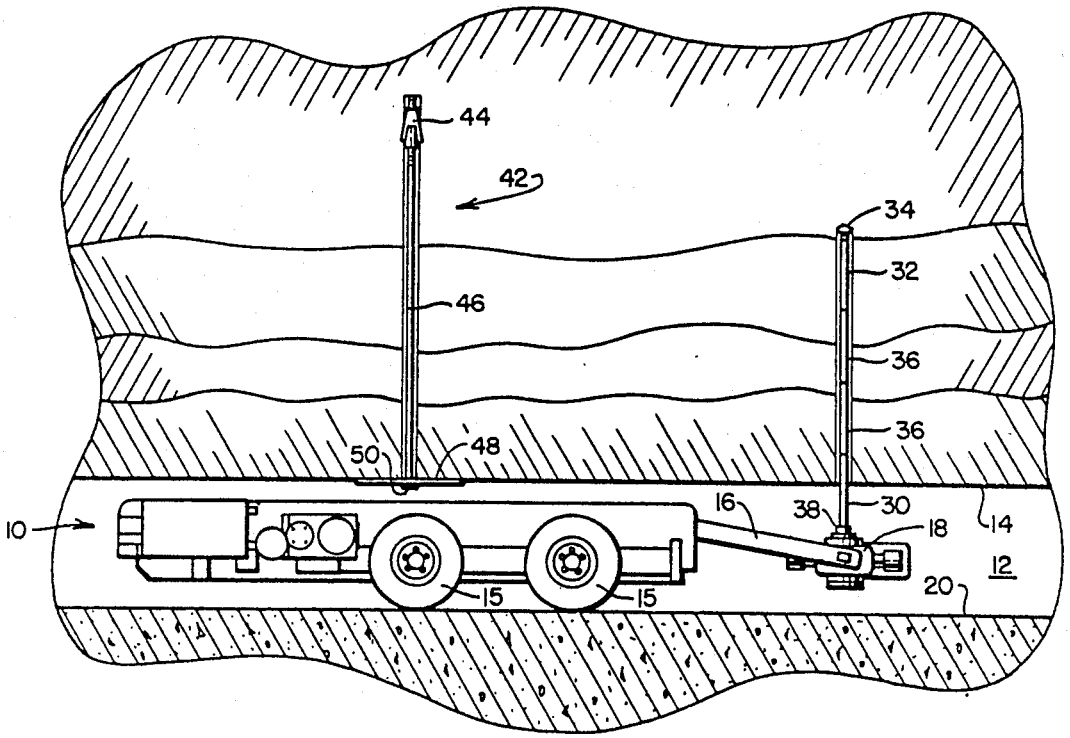
FIG. 1 is a sectional pictorial view of a mining operation wherein a roof drilling machine is providing bores for the insertion of roof bolts.

Referring to FIG. 1, a typical roof drilling machine is depicted generally at 10. Machine 10 is designed such that it operates in conjunction with the relatively low seams of coal now often encountered in mining operations. For example, the roof 14 of the subterranean cavern 12 formed subsequent to the removal of coal from the seam may be as low as about thirty inches, a height still of magnitude sufficient to carry out mining operations. In conventional mining practice, following the extraction of a given quantity of coal or other mined commodity, from the seam, extraction and shuttle mechanisms are removed from the recently mined area and drilling machines as at 10 are advanced to aid in carrying out necessary roof bolting operations to secure roof 14. The drilling machines generally are supported and propelled by rubber tired wheels as at 15 and incorporate one or more articulated boom components as at 16 each of which supports a drill head 18. The boom components 16 are operated by a miner and may be lowered such that head 18 touches the floor 20 of the cavern. In the course of providing a vertical bore, the miner inserts the drive-in portion of a starter steel component within the chuck and receiving cavity of drill head 18.

Figure 2:
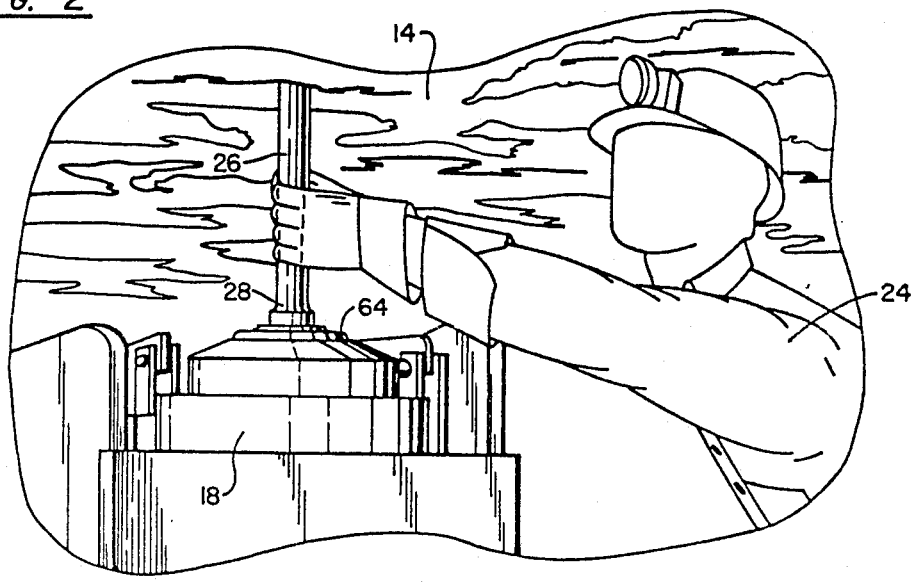
FIG. 2 is a pictorial representation of a miner operating at the drill head of a drilling machine under low roof conditions.
Figure 3:
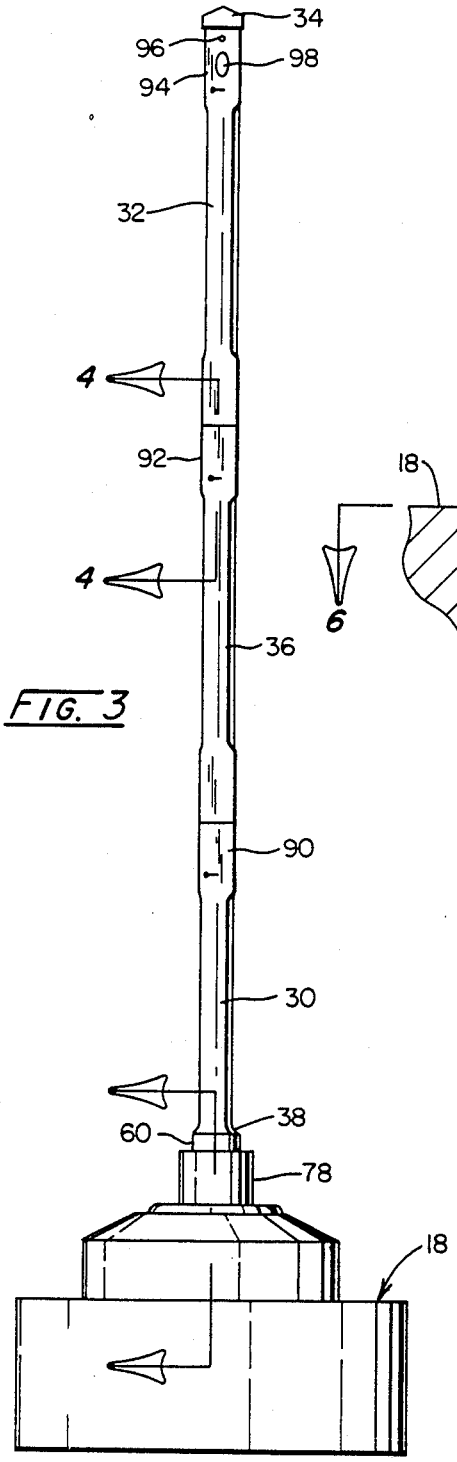
FIG. 3 is a elevational view of a drill head and chain of components forming a drill steel assembly.

Starter steel components generally will incorporate a drill bit at their tip and the head 18 rotates the assemblage while being elevated by boom 16 in a manner defining a consistent vertical drill axis orientation. Such starter steel varies in length depending upon seam height, for instance from about twelve inches (0.3 m.) in length to about ninety-six inches (2.4 m.). As revealed in FIG. 2, the miner as represented at 24, usually supports the starter steel 26 by hand. The latter figure again illustrates the roof at 14, as well as the drive-in portion 28 of starter steel 26. The figure further is intended to evidence the somewhat arduous working conditions imposed upon the miner under low roof conditions. Further in this regard, recall that roof 14 remains unsupported during the drilling operation. Following the drilling of an initial bore with starter steel 26, the boom 16 is lowered by the operator, the starter steel and associated drill bit are removed and a driver steel component, as represented at 30 in FIGS. 1 and 3, is inserted within the receiving cavity of the chuck of drill head 18. To this driver steel component 30 is attached a "finisher" which serves as a holder for the drill bit for ensuing drilling operations. Such a finisher component is represented in FIGS. 1 and 3 at 32, while the drill bit, conventionally formed of carbide, is represented at 34. In some drill steel designs, the driver and starter steel are provided as a single component.

For low seam coal, a succession of such drill elongating manipulations are required, a predetermined number of middle extension components, as represented at 36 in FIGS. 1 and 3, being inserted between the driver steel component 30 and finisher component 32 to achieve requisite bore height. Of course, the lengths of any of the above components selected will depend upon a seam height encountered. The bores and diameters of drill steel components are represented in exaggerated fashion in FIG. 1 in the interest of clarity.

Upon completion of a bore, the drill steel assembly or chain must be removed therefrom and the general practice in this regard is to lower boom 16 and head 18. As the head 18 is lowered, the drive-in portion 38 of the driver steel component 30 slides directly outwardly from the receiving cavity of the rotatable chuck. Grasping the exposed shank portion of the driver steel 30 and subsequent extensions 36 as well as finisher 34, the miner then, by hand, guides the drill steel from the formed bore. In theory at least, the steel slides downwardly under the influence of gravity and the components thereof are in readiness within the mine cavern for the next drilling operation. However, due to the rigorous environment of the drilling operation as well as due to the vagueries of overhead seam structure and the like, such facile removal of the drill steel assembly may not be the case. Often, off-axis drilling and bending of the components takes place and the various portions thereof will not readily slide from the bore. The miner then is called upon to grasp the frictionally heated lowermost portion of the drill steel and yank or utilize hammer blows as above described in order to forcibly attempt removing the steel from the bore, all such procedures being carried out while the miner is positioned beneath unsupported roof. As is apparent, drill steel often is left wedged within the bores and mining accidents are encouraged with the manual attempts at removal.

Following formation of the bore by machine 10, roof bolts are inserted, anchored and tensioned to secure the overhead strata. Such a roof bolt arrangement is represented in exaggerated fashion in FIG. 1 at 42. A typical steel roof bolt is somewhat flexible in nature, usually having a point anchor present as an expansion shell or the like as represented generally at 44. A shank 46 extends from the anchor 44 and terminates in a threaded end extending through a face plate 48 positioned aganst roof 14. A nut or the like as at 50 is rotated about shank 46 to provide a requisite tensioning of shank 46. As noted earlier, other, resin retained roof bolts have been developed over the recent past, however, such bolts also require the pre-drilling of a bore.

In accordance with the present invention, a unique, quick release interlocking of a driver steel component 30 with the chuck of drill head 18 is provided such, that when boom 16 is hydraulically lowered to floor level 20, the drill assembly or chain is automatically forcibly urged from the bore. Once head 18 is lowered to floor level 20, only a simple twisting motion of the part of the miner is required to separate the driver steel from the chuck of drill head 18. The distance thus traveled by head 18 in removing the drill steel assemblage generally will be found to be sufficient to readily facilitate the removal of the remaining components such as extensions 36, finisher 32 and coupled bit 34. In the discourse to follow, reference will be made to the driver portion 30 of the assembly, however, the same operation in removing drill steel and interconnecting the lowermost portion of either starter or driver bars with the receiving cavity of the chuck of drill head 18 remains the same. That is, the instant system works both with driver steel, with starter steel and with structures wherein the driver and starter function are combined in a single component.

Figure 5:
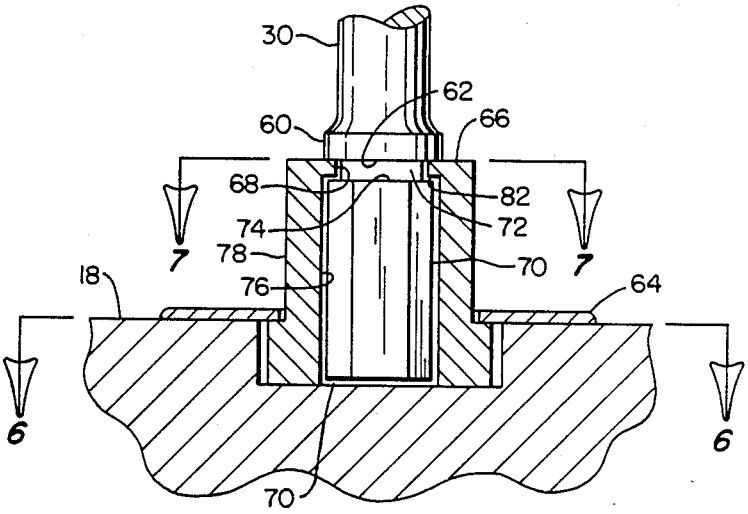
FIG. 5 is a sectional view of the drive-in portion of a drill steel starter or driver component shown in conjunction with the chuck and receiving cavity of a drill head, the section being taken through the plane 5—5 of FIG. 3.

As represented in FIG. 3, the lowermost portion 38 of driver component 30 is formed, inter alia, having a flange or boss 60 flaring outwardly in annular fashion and having a bearing surface 62 (see FIG. 5) formed transversely to the axis of the drill assembly. Bearing surface 62 serves to aid in the alignment of the drill assembly along the drill axis and rides slideably over the upward surface of a chuck 78 or the like. A retainer 64 is fixed to the upper housing of drill head 18 by bolts or the like (not shown). As is revealed in FIG. 7, chuck 78 has an elevated annular shaped flat central portion 66 through which is formed a non-circular, substantially hexagonal opening 68. Opening 68 is formed having a periphery corresponding with the right cross-section of the noncircular driver lowermost portion 70 of driver component 30. Looking additionally to FIG. 5, in the embodiment shown, lowermost portion 70 is of hexagonal cross-section and, accordingly, opening 68 is of corresponding hexagonal shape, being dimensioned to permit portion 70 to slide therethrough in closely nesting fashion. The hexagonal driven portion 70 is integrally coupled through a cylindrically shaped neck 72 to the drive-in portion 38. Thus associated, a bearing surface 74 is defined between the lowermost periphery of neck 72 and the upper surface of driven lowermost portion 70. Driven lowermost portion 70 is designed to slide through opening 68 of chuck 78 and into the receiving cavity 76 of drill head 18. Looking additionally to FIG. 6, this receiving cavity is provided with a 25 splined driven chuck 78 which is rotated within drill head 18 to impart rotary drilling motion to driver steel 30. It should be understood that several varieties of chuck devices can be utilized to provide the requisite receiving cavity, with means for driving the driver steel 30 and through it the extension 36, the finisher component 32 and the drill bit 34.

Figure 6:
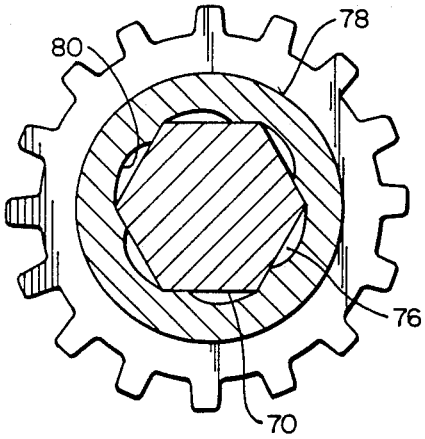
FIG. 6 is a partial sectional view of FIG. 5 taken through the plane 6—6 thereof.
Figure 7:
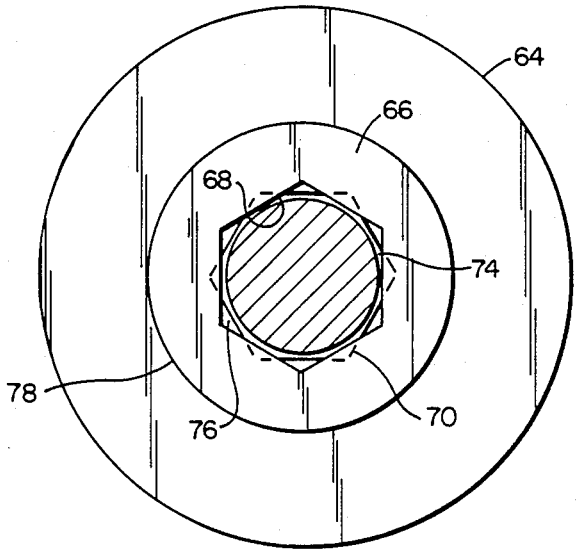
FIG. 7 is a partial sectional view taken through the plane 7—7 of FIG. 5.

FIG. 6 further reveals that the edge of receiving cavity 76 is formed having a right cross-sectional profile for providing a predetermined extent of rotational lost motion freedom about the drill axis with respect to the corresponding edge profile of driven lowermost portion 70. In particular, for the hexagonal cross-section defined by the latter, the profile 80 of cavity 76 is formed having six lobes within each of which a corner of the portion 70 is rotatable to the extent of the noted lost motion. Note, that upon rotation of chuck 78, six surfaces of contact between profile 80 and the surface of driven portion 70 are established. It additionally may be observed that, by rotating either chuck 78 or driven portion 70, an alternate twelve such bearing surface tangencies are provided, the extent of rotation between the two bearing configurations representing one-twelveth turn or thirty degrees of rotation about the drill axis. Advantageously, more than a mere point of contact between the profile 80 of the receiving cavity 76 and the corresponding contacting surface of portion 70 is provided to assure that no excessive stress is imparted to the driven lowermost portion 70. For example, should only a point contact be established, the surface of portion 70 would be prone to be distorted upon driven rotation, thus lessening the life and reliability of the system. It has been discovered along this line that the cross-sectional area of impact of the profile 80 against lowermost portion 70 is critical, in that, with conventional drill steel the impact area must be at least 0.65 square inches. For that reason the length of the chuck 78 and lowermost portion are elongated in comparison to the functionally equivalent area illustrated in FIG. 5 of U.S. Pat. No. 4,226,390.

Insertion of the driving portion 38 of driver steel 30 in the course of operation is straightforward and relatively simple, ample statistical opportunity for adequate alignment between opening 68 of chuck 78 and cavity 76 being provided. In the event of a misalignment not permitting ready insertion, only a small rotation of chuck 78 is required to achieve necessary insertion, a procedure not requiring undue effort on the part of the miner-operator. At the completion of a bore, however, bearing surface 74 usually will be oriented such that it contacts the lower surface 82 of the central portion 66 of chuck 78. Should this not be the case, a simple reverse rotation of component 30 will provide for an appropriate contact between those surfaces. Such contact being established, the miner actuates drilling machine 10 to lower boom component 16 and the driver rod 30, as well as components interconnected therewith, are driven downwardly from the bore. As component 30 passes through roof 14 (FIG. 1) it is removed from the assemblage. The remaining components such as middle extensions 36, finisher 32 and drill bit 34 are removed manually by the miner. Inasmuch as these latter comonents have been moved downwardly at least to the extent of the length of driver steel 30, they normally will be removed without difficulty.

Figure 4:
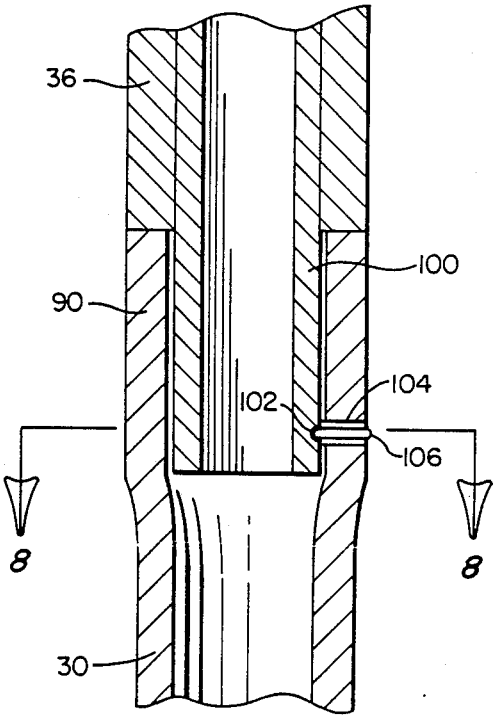
FIG. 4 is a sectional view of the coupling of components of a drill steel chain taken through the plane 4—4 of FIG. 3.

To facilitate the removal of the entire drill steel assemblage, the instant invention further provides a tensile resistive interconnection and disassembly arrangement. Looking to FIGS. 3 and 4, it may be observed that the end of driver steel component 30 oposite its drive-in portion 38 is configured to define the female component of a socket, as represented at 90. As clearly appears to FIGS. 4, 8, and 9 the female component of the socket is non-circular. Actually it is shown as square in FIG. 8 and hexagonal in FIG. 9. Preferably, the main portions of the driver steel component 30, the finisher component 32, and the middle extension 36 are circular in cross-section. An identical female socket is present at one end of each middle extension 36, as represented in FIG. 3 at 92. The finisher component 32, while providing a female socket 94 at its uppermost end, utilizes a socket structure designed only to receive the shank of drill bit 34. The upper socket also is configured having a transverse hole 96 through which a pin is inserted to prevent the rotation of bit 34 within the female socket during drilling operations. Additionally incorporated in the vicinity of socket 94 are duct return holes, one of which is revealed at 98. In operation, the hollow assemblage is subjected to a vacuum asserted from drill head 18 to remove dust generated by bit 34. The lowermost disposed ends of both the middle extensions as at 36 and the finisher steel 32 are configured having the male socket components or ends 100 of cross-section corresponding with female sockets 90. In conventional practice, there is no technique for restraining the male and female components of these socket assemblies from pulling apart in the course of removing the drill assembly from a bore except for that revealed in U.S. Pat. No. 4,226,290. As noted above, should pins or the like be utilized for this purpose, the miner would be required to carry a hammer and punch for driving a pin through mated holes to effect its removal during the drill steel removal and disassembly procedure. Such procedures result in the losing of pins as well as punches and a requisite hammering upon the drill steel assembly as it protrudes from unsupported roof.

Figure 8:
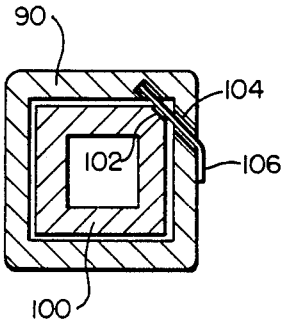
FIG. 8 is a sectional view taken through the plane 8—8 of FIG. 4.

Referring additionally to FIG. 8, in accordance with the instant invention a shallow groove 102 is formed across one or more of the corners of the male socket insert 100 adjacent to the lower portion of the end of the male socket insert 100. This groove, being positioned about three-eights inch from the tip of male end 100, communicates with a transversely formed bore or hole 104 extending through female socket component 90. As the drill steel is assembled in the course of drilling a bore, the male and female components 90 and 100 are joined and the miner inserts a small length of wire 106 through hole 104 to an extent wherein it enters a portion of groove 102. The remainder of the wire merely protrudes and is folded against the side of the female socket surface in the course of drilling. This wire 106, communicating with groove 102, provides a simple locking of the components 90 and 100 of the socket assembly permitting an adequate tensional restraint for removal of the drill steel without losing components within the bore resulting in abandonment of the bore and loss of steel. The lower positioning of the groove 102 upon male socket component 100 assures no perceptible loss in the aligning strength and rigidity of male component 100. As the steel components are removed from the bore, the miner need only pull the wire 106 from hole 104 and discard it. The only tool required is a pair of pliers and quantities of wire are conventionally available at the mining operational locals of a coal mine or the like.

Figure 9:
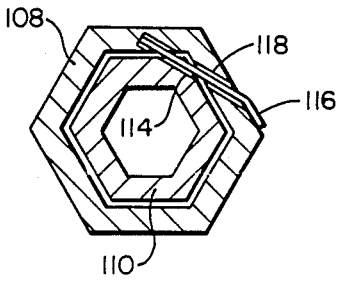
FIG. 9 is a cross-section of a socket component of a drill steel assembly similar to FIG. 8 but showing a hexagonal structure.

FIG. 9 shows an embodiment for connecting the male and female portions of a socket connection in the instance of the utilization of hexagonally styled drill steel components. In this regard, the female socket component is represented in cross-section at 108, while the corresponding male insert component is represented at 110. An access bore 118 is provided within female component 108 to communicate with a groove 114 formed male component 110. A locking wire 116 is shown inserted in the manner described above.

Figure 10:
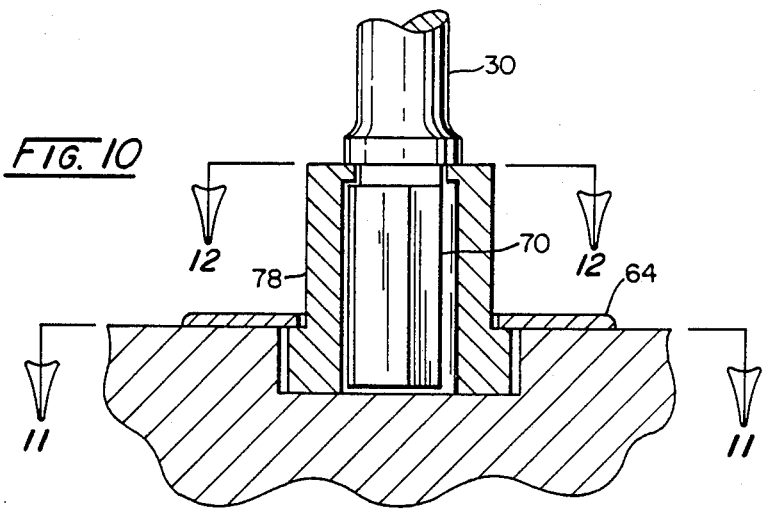
FIG. 10 is a sectional view similar to FIG. 6 of a second embodiment of the chuck and receiving cavity.
Figure 11:
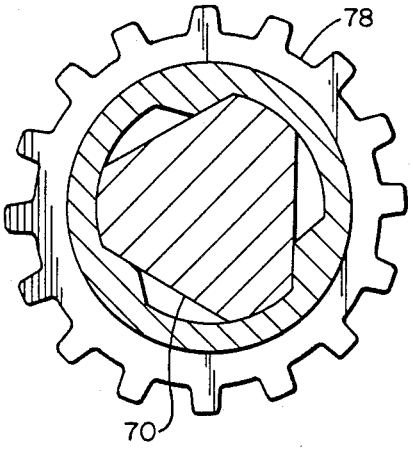
FIG. 11 is a sectional view taken along line 11—11 of FIG. 10.
Figure 12:
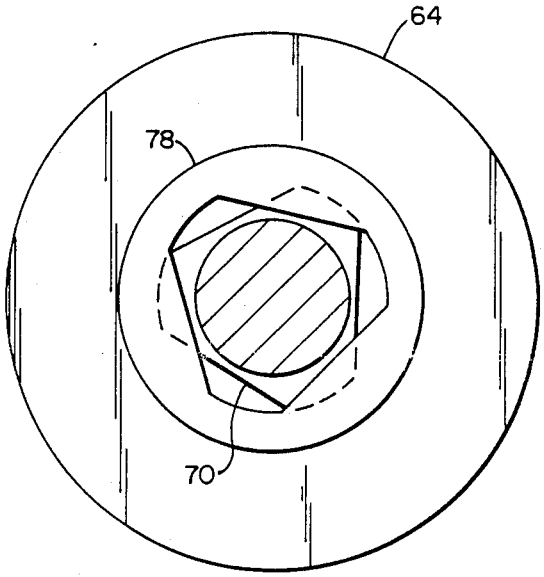
FIG. 12 is a partial sectional view taken along line 12—12 of FIG. 10.

FIGS. 10–12 illustrate another embodiment of the invention wherein the chuck 78 and the lower end of the drive steel 70 are structured to provide three points of contact during the drilling operation as opposed to the six points shown in FIG. 6. The critical feature is not the number of points of contact but rather the cross-sectional area for impact as described above. The same lost motion concept is incorporated except for the degree of rotation. The structure appears to be self-explanatory without further elaboration except for the description of the operation which follows.

FIGS. 13–15 illustrate a third embodiment wherein the chuck 78 and associated drive steel 70 provide four points of contact. Note is made that the neck 120 and drive steel 70 are even further elongated as compared to the embodiments illustrated in FIGS. 5 and 10. The contact surface has also been increased to about two square inches to prevent premature impact failures in particularly hard rock. This is accomplished by the elongation of the lower end of the drive steel 70 to about 1.4 to 1.5 inches and adjusting the angle 122 of lost motion to about 20–30° as measured from a line extending radially of the axis 126 of the chuck through a corner of opening 68 and extending through the edge of the impact area, best seen in FIG. 14. Thereby, the mass of the impact areas 124 is increased. Obviously, the angle 122 will change when there are more than four or fewer than four impact areas.

The elongation of the neck 120 as illustrated in FIG. 13 is to separate the points of stress concentration inherent in sharp corners in a body under stress. Note also the beveled edge 128 of the opening 68. The sloping edge facilitates the insertion of the portion 70 of the drive steel into the opening 68 and the miner who is operating in artificial light with accompanying shadows needs all the help he can get.

Operation

Coal having been removed from subterranean cavern 12, and mining machines used in the removal of the coal having also been removed, a drilling machine 10 is driven into the cavern 12 as shown in FIG. 1. The drill head 18 is lowered by boom components 16 to the floor of the cavern 12. The miner inserts a starter steel component 26 within the chuck 78 and receiving cavity 76 of the drill head 18. This starter steel is locked in the chuck 78 in the cavity 76 by a turn of the starter steel. It will automatically lock, if desired, on its rotation during the drilling operation. Either the starter steel component (which is of a length no longer than the height of the cavern) has a drill bit at its upper tip or a separate drill bit is securred thereto. The machine 10 operates the starter component 26 to drill a bore of a length correspondig approximately to the distance between the floor and roof of the cavern 12. The drill head is then lowered to the floor. The starter component is removed manually from the chuck 78 and the receiving cavity by a reverse twist and a "finisher" 32 with a drill bit 34 is inserted manually up into the previously formed bore. To the lower end of this is attached a driver steel component 30 by the insertion of the lower male end of the finisher 32 into the upper female end of the driver steel component 30. The component 30 is secured to the "finisher" steel 32 by a wire such as 106 or 116 (See FIGS. 8 and 9). The lower end of the driver component 30 is secured in the receiving cavity 76 and chuck 78 either, automatically as the drill head 18 turns or by a simple manual twist. The machine then drives the drill head and the driver steel together with the finisher another increment of the bore. If the bore formed is not of sufficient length further components must be inserted. To do this the drill head 18 is again lowered pulling the driver component 30 down and thus pulling the finisher component 32 and the drill bit 34 with it. The finisher component 32 is disconnected from the driver steel 30 and an extension steel such as 36 is added to the finisher component 32 and secured by a wire such as wire 106 and pushed up manually as far as it will go. Then the lower end of the extension steel component 36 is similarly secured to the top of the driver component 30 and the drill head 18 is operated to continue the operation of drilling the bore as far as may be desired.

To remove the drill steel similar operations are performed. The drill head is lowered pulling the chain of drilling steel from the bore. The chain having been pulled down, it is loosened in the bore and may be rotated manually by the miner to release the entire chain from the drill head. Then all of the steel may be easily pulled, disconnecting each portion of the drill chain as it is brought into the cavern 12.

Since certain changes may be made in the above system and apparatus without departing from the scope of the invention herein involved, it is intended that all matter contained in the above description or shown in the accompanying drawings shall be interpreted as illustrative and not in a limiting sense.

We claim:

1. In roof drilling systems for use in subterranean mining applications wherein a drill head is selectively driveably elevated from and lowered to floor level along a drill axis and includes a rotatably driven chuck having a receiving cavity of fixed peripheral dimension for slideably receiving and laterally abuttably engaging for rotation about said drill axis the driven lowermost part of the drive-in portion of an elongate rod component of roof drill steel, the improvement comprising:

a drill steel assembly component having an elongate portion fixed to and extending from said drive-in portion, said drive-in portion being configured having said driven lowermost portion of predetermined non-circular profile and given maximum cross-sectional dimension, said driven lowermost portion extending a predetermined length to a neck portion fixed thereto and having a maximum cross-sectional dimension less than said driven lowermost portion maximum cross-sectional dimension to define a first bearing surface therebetween, said neck portion extending from said first bearing surface and fixed to said elongate portion;

said drill head receiving cavity being configured having a right cross-sectional profile for providing, a predetermined extent of rotational lost motion freedom about said drill axis with respect to said driven lowermost portion non-circular profile when the latter portion is inserted thereinto;

means for locking the chuck to the drill head;

means for locking the chuck and drill steel together, said means for locking the chuck and drill steel comprising a flange on the chuck having a non-circular aperture formed therein, the profile of which is configured to slideably insertably receive said driven lowermost portion of said drive-in portion, the lowermost surface of said means for locking the chuck and drill steel providing a second bearing surface abuttable against said first bearing surface when said drill head is lowered, whereby said elongate rod component of drill steel may be driveably removed from a bore formed thereby; and the chuck and drive-in portion including an impact area to prevent relative rotation of the two, said impact area being about two square inches within said chuck below said second bearing surface.

2. The roof drilling system of claim 1 in which said drill steel assembly component driven lowermost portion is configured having a square cross-section, and said chuck and drill steel locking means aperture is configured substantially as a square.

3. The roof drilling system of claim 2 including means on the chuck to facilitate the insertion of the driven lowermost portion.

4. The roof drilling system of claim 1 in which said drill steel assembly component driven lowermost portion is configured having a square cross-section, and said neck portion is configured as a right cylinder.

5. The roof drilling system of claim 4 in which said neck portion is configured having a length substantially corresponding to the thickness of said chuck and drill locking means.

6. The roof drilling system of claim 5 in which said drill steel assembly drive-in portion neck portion extends to a collar to define a third bearing surface at its junction therewith.

7. The roof drilling system of claim 4 including means on the chuck to facilitate the insertion of the driven lowermost portion.

8. The roof drilling system of claim 1 in which said drill head receiving cavity cross-sectional profile is configured for providing said rotational lost motion freedom of about 20°-30° about said drill axis.

9. The roof drilling system of claim 1 in which said roof drill steel is configured for optional expansion along said drill axis by the select interconnection of middle extension components from a driver component, said driver component having a said drive-in portion at one end and a female socket of predetermined non-circular interval cross-section at the opposite end; each said middle extension component having a male end having a corresponding non-circular cross-section shaped to be received in closely nesting fashion within a said female socket, and a said female socket at the opposite end thereof; each said male end having a groove adjacent the tip thereof and each said female socket having a transverse hole through the wall thereof so positioned as to directly communicate with a said groove when said male end is inserted thereinto, said hole and said groove being dimensioned to receive a manually insertable locking wire which, upon said manual insertion, serves to retain said male end within said female socket.

10. The roof drilling system of claim 9 in which said male end groove is configured having an internal minimum transverse cross-sectional dimension substantially equivalent to the corresponding minimum transverse cross-sectional dimension of said male end.

11. The roof drilling system of claim 9 in which said locking wire is formed of steel and configured for manual flexure.

12. The roof drilling system of claim 9 in which said groove is positioned about $\frac{5}{8}$ inch from the tip of said male end.

13. The roof drilling system of claim 1 wherein the chuck extends upwardly along the drive-in portion of the drill steel above the means for locking the chuck to the drill head.

14. The roof drilling system of claim 1 in which said drill steel assembly component driven lowermost portion is configured having a hexagonal cross-section, and said neck portion is configured as a right cylinder.

15. The roof drilling system of claim 14 in which said drill steel assembly drive-in portion neck portion extends to a collar to define a third bearing surface at its junction therewith.

16. The roof drilling system of claim 15 in which said roof drill steel is configured for optional expansion along said drill axis by the select interconnection of middle extension components from a driver component, said driver component having a said drive-in portion at one end and a female socket of predetermined non-circular interval cross-section at the opposite end; each said middle extension component having a male end having a corresponding non-circular cross-section shaped to be received in closely nesting fashion within a said female socket, and a said female socket at the opposite end thereof; each said male end having a groove adjacent to the tip thereof and each said female socket having a transverse hole through the wall thereof so positioned as to directly communicate with a said groove when said male end is inserted thereinto, said hole and said groove being dimensioned to receive a manually insertable locking wire which, upon said manual insertion, serves to retain said male end within said female socket.

17. The roof drilling system of claim 16 in which said groove is positioned about $\frac{5}{8}$ inch from the tip of said male end.

18. The roof drilling system of claim 1 wherein the driven lowermost portion is about 1.4 to 1.5 inches in length.

19. The roof drilling system of claim 18 including means on the chuck to facilitate the insertion of the driven lowermost portion.

20. The roof drilling system of claim 1 including means on the chuck to facilitate the insertion of the driven lowermost portion.

* * * * *